US009982497B2

(12) United States Patent
Foley

(10) Patent No.: US 9,982,497 B2
(45) Date of Patent: May 29, 2018

(54) MUD CONTAINMENT APPARATUS HAVING PNEUMATIC SEALS

(71) Applicant: FOLEY PATENTS, LLC, Abbeville, LA (US)

(72) Inventor: Lawrence E. Foley, Lafayette, LA (US)

( * ) Notice: Subject to any disclaimer, the term of this patent is extended or adjusted under 35 U.S.C. 154(b) by 207 days.

(21) Appl. No.: 14/978,410

(22) Filed: Dec. 22, 2015

(65) Prior Publication Data

US 2016/0177642 A1 Jun. 23, 2016

Related U.S. Application Data

(60) Provisional application No. 62/095,474, filed on Dec. 22, 2014.

(51) Int. Cl.
*E21B 21/01* (2006.01)

(52) U.S. Cl.
CPC ..... *E21B 21/01* (2013.01)

(58) Field of Classification Search
CPC ..... E21B 19/16; E21B 19/18; E21B 21/01
See application file for complete search history.

(56) References Cited

U.S. PATENT DOCUMENTS

| | | | | | |
|---|---|---|---|---|---|
| 2,096,882 | A * | 10/1937 | Chernosky | E21B 33/08 | 15/220.4 |
| 2,214,428 | A * | 9/1940 | Miller | E21B 21/01 | 166/81.1 |
| 2,353,412 | A * | 7/1944 | Miller | E21B 33/08 | 166/81.1 |
| 5,295,536 | A * | 3/1994 | Bode | E21B 21/01 | 166/241.7 |
| 6,119,772 | A * | 9/2000 | Pruet | E21B 21/01 | 166/81.1 |
| 8,839,853 | B1 * | 9/2014 | Angers, Jr. | E21B 21/01 | 166/81.1 |
| 9,664,002 | B2 * | 5/2017 | Webb | E21B 19/16 | |
| 2005/0205303 | A1 * | 9/2005 | Pearson | E21B 21/01 | 175/57 |
| 2011/0265992 | A1 * | 11/2011 | Pearson | E21B 21/01 | 166/267 |
| 2015/0176350 | A1 * | 6/2015 | Webb | E21B 19/16 | 166/77.51 |

* cited by examiner

*Primary Examiner* — Frederick L Lagman
(74) *Attorney, Agent, or Firm* — Ted M. Anthony

(57) ABSTRACT

A mud containment apparatus has pneumatically energized seals for sealing against the outer surface of tubulars such as drill pipe. The mud containment apparatus can be quickly and efficiently positioned about a threaded connection existing between adjacent pipe sections. During separation of the threaded connection, the mud containment apparatus contains and saves drilling fluid, thereby preventing drilling fluid from uncontrolled splashing or spilling.

16 Claims, 7 Drawing Sheets

MUD CONTAINMENT APPARATUS HAVING PNEUMATIC SEALS

CROSS REFERENCES TO RELATED APPLICATION

Priority of U.S. Provisional Patent Application Ser. No. 62/095,474, filed Dec. 22, 2014, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a mud containment apparatus, frequently referred to as a "mud bucket", for preventing fluid from uncontrolled spillage when joined sections of pipe are separated on a drilling rig. More particularly, the present invention pertains to a mud containment assembly that can be quickly and efficiently positioned around connected sections pipe, and that contains and collects fluids (such as, for example, drilling mud and/or additives) when said pipe sections are separated. More particularly still, the present invention pertains to a mud containment apparatus that comprises a plurality of fluid pressure sealing members that can be selectively energized for engagement against said pipe.

2. Brief Description of the Prior Art

Drilling rigs typically comprise a supportive rig floor, a derrick that extends in a relatively vertical direction above said rig floor, and a lifting device that can be raised and lowered within said derrick. Generally, a wellbore is positioned beneath said rig floor and derrick and extends in a relatively downward direction into subterranean strata. During drilling operations, said drilling rig and associated equipment can, among other things, be used to move tubular goods, such as drill pipe, casing and/or other tubulars, into and out of said wellbore.

Frequently, boring drill bits and/or other equipment can be lowered into a wellbore and manipulated within said wellbore via a tubular work string. For example, oil and gas wells are generally drilled by rotating a boring bit located at the distal end of a length of a tubular drill string; said drill string comprises a plurality of individual joints of drill pipe that are threadably and coaxially connected to one another in end-to-end relationship.

A fluid, generally known as drilling mud or drilling fluid, is often pumped into a through-bore of such drill pipe during the drilling process. Said drilling mud is circulated back to the drilling rig through an annulus formed between the outer surface of said drill pipe and the inner surface of the wellbore. After exiting said wellbore annulus, the drilling mud is directed into a plurality of mud tanks that are beneficially located on or near the drilling rig. Such circulated drilling mud can then be filtered and cleaned before being pumped back through the through-bore of the drill pipe and re-circulated through said wellbore.

Drilling mud can serve several purposes. For example, such drilling mud can be used to provide a hydrostatic head to offset downhole fluid pressures observed in a wellbore; the density of the drilling mud can be adjusted using weighting material and/or additives in order to provide a desired hydrostatic head. Drilling mud can also be used to lubricate and cool a downhole drill bit, and to carry drilled rock cuttings or pieces to the surface. Additives and chemicals are frequently added to drilling mud in order to provide or adjust the various characteristics and/or performance of such drilling mud.

Drilling mud, with or without additives, can be harmful to rig personnel. Exposure to said drilling muds and/or additives can frequently cause allergic skin reactions and other health problems. Additionally, said drilling mud and additives can be environmentally hazardous and extremely expensive. As a result, it is virtually always desirable to contain said drilling fluids and to prevent said drilling fluids from splashing, spilling and/or otherwise contacting personnel and drilling rig equipment that is not part of the mud system.

When removing a string of pipe from a wellbore (such as, for example, in order to remove and change a drill bit located at the bottom or distal end of the drill string)—a process often referred to as "tripping out of the hole"—pipe is removed from the well one or more sections at a time. During such tripping, the upper end of the drill string is lifted within a drilling rig derrick until a threaded connection between two joints of drill pipe is positioned a relatively short distance above a rig floor. Thereafter, the pipe string is suspended or hung in place at the rig floor using a device commonly known as "slips".

After the slips have been set and the pipe is secured in place within the wellbore said threaded connection can then be "broken-out" or loosened by tongs or other torque application means. After said threaded connection is broken out, the uppermost (now disconnected) section(s) of pipe can be completely unscrewed, removed from the drill string and stored within the derrick or on a pipe rack, and the process can be repeated until a desired length of pipe is removed from said wellbore.

In many cases, drill pipe lifted within a drilling rig derrick is at least partially filled with drilling mud. As a result, a considerable volume of drilling mud contained within said pipe can spill and/or splash onto the rig floor following unscrewing of said threaded connection and separation of two adjacent pipe sections above said rig floor. Such drilling mud can splash on personnel and get into their eyes or come in contact with their skin; the drilling mud can also spill off of the rig floor and into the surrounding environment. Drilling mud on a rig floor or other surfaces can create a slipping hazard to rig personnel. Expensive drilling mud lost in this manner must then be replaced instead of being re-used.

Attempts have been made to solve the problem of controlling the spilling of drilling fluids during separation of a threaded connection using a device commonly referred to as "mud bucket". Generally, such mud buckets comprise a substantially cylindrical-shaped container fabricated by splitting or cutting a length of a relatively large diameter pipe along a mid-plane through its longitudinal axis, thereby creating two substantially semi-cylindrical halves of roughly equal size. Said two halves of said cylinder are hinged along one long side and include a latching or locking mechanism opposite said hinge.

An elastomer sealing member is disposed in a relatively horizontal configuration at both the upper and lower ends of said cylinder, while an elastomer strip seal is disposed in a relatively vertical configuration between said two halves of said cylinder. Further, an opening at the bottom end of one of the cylinder halves permits fluids received in an inner volume of the mud bucket to evacuate to a mud tank or other drilling mud reservoir via a hose.

During operation, the opposing semi-cylindrical half members of a mud bucket may be hinged open or spread apart. In this configuration, said mud bucket is placed in close proximity to a mated threaded connection between two adjacent sections of pipe positioned above a drilling rig floor. Said opposing semi-cylindrical half members can then be closed against each other (using said hinge) in order to envelop said threaded connection and a portion of the surrounding drill pipe. Thereafter, the mud bucket may be latched in order to surround said threaded connection and secure said opposing semi-cylindrical members in a closed or joined relationship.

Upper and lower elastomer sealing members located near the upper and lower ends of said opposing semi-cylindrical half members have substantially semi-circular or concave sealing surfaces. Said concave upper elastomer sealing members contact the external surface of drill pipe above said threaded connection, while said concave lower elastomer sealing members contact the external surface of drill pipe below said threaded connection. Elastomer strip sealing members contact the opposing, mating faces of the opposing semi-cylindrical half members.

During use, the mud bucket is suspended from a cable above a drilling rig floor, moved into position by rig personnel, and latched around the drill pipe in order to enclose a threaded connection. In most cases, a mud bucket is positioned and secured in this manner after mating threads of a threaded connection have been "broken-out", but before said mating threads are completely disconnected and the adjoining pipe sections are separated. As such, after the mud bucket has been properly positioned latched in place, the upper pipe section is rotated to fully disconnect the threaded connection. Thereafter, said upper pipe section is axially lifted in order to separate it from the lower pipe section. With the mud bucket secured in place surrounding said threaded connection, drilling fluid flows out of the disconnected upper pipe section, into an interior chamber formed by the mud bucket, through the hose, and into the mud tank or other storage reservoir.

A significant problem with conventional mud bucket design is that said seals require a considerable amount of force in order to effectively seal against the external surface of the pipe sections. Additionally, rotation and axial translation of said pipe (which can have rough outer surfaces) through the seal members can cause abrasive wear and damage to the inner sealing surfaces of the seal members. In many cases, the elastomer sealing members cannot compensate for this wear, thereby causing said sealing members to leak. Likewise, the elastomer strip sealing member cannot compensate for wear or damage, and thus, said elastomer strip sealing member can also begin to leak. Generally, the elastomer seals are fastened to the mud bucket components via nuts and bolts and, thus, replacement of said seals can be inefficient and time consuming. Moreover, said nuts and bolts are subject to being lost or falling into a wellbore.

As a result, there is a need for a mud bucket that is relatively light-weight in order for said mud bucket to be safely moved and positioned along the rig floor; that comprises a means to compensate for wear to pipe sealing members; that can compensate for wear or damage to strip sealing members; that is easy to latch and unlatch; and, that comprises effective fluid sealing members that may be changed rapidly and easily without the removal of small components (such as, for example, nuts and bolts).

SUMMARY OF THE INVENTION

The present invention comprises a mud containment apparatus, or a mud bucket, having a plurality of pneumatically actuated sealing members for selectively creating a fluid pressure seal against certain opposing surfaces.

In a preferred embodiment, the present invention comprises a first semi-cylindrical half member and a second semi-cylindrical half member; although other manufacturing means can be envisioned, said first and second half members can be created by axially splitting a length of tubing or pipe through a relatively center mid-plane along a longitudinal axis of said tubing or pipe. Said two semi-cylindrical half members can be attachably connected to each other using at least one hinge or other similar connection means disposed along the length of said semi-cylindrical half members, wherein a longitudinal axis of said at least one hinge is oriented substantially parallel to the longitudinal axis of said semi-cylindrical half members.

Said semi-cylindrical half members can hingedly move between a first open or spread apart position, and a second closed or joined position. In said open position, said semi-cylindrical half members pivot about said at least one hinge in order to spread apart from each other. In said closed position, said semi-cylindrical half members pivot about said at least one hinge and move together until the opposing longitudinal edges of said first and second semi-cylindrical half members meet or coincide, thereby forming a substantially closed cylinder. A plurality of handles can be disposed on each semi-cylindrical half member in order to facilitate gripping by personnel and manual rotation of said semi-cylindrical half members about said at least one hinge.

The mud containment apparatus of the present invention can be disposed in many different positions or orientations. It is to be observed that in most applications, said mud containment apparatus will be positioned so that the longitudinal axis is oriented generally parallel to a pipe string being removed from a well bore using a drilling rig—thus, in this configuration, said mud containment apparatus is positioned in a substantially vertical orientation. As such it is to be observed that directional terms such as "vertical", "horizontal", "left" and "right" are used herein for ease of reference, but should not be viewed as limiting in any manner.

In a preferred embodiment, the mud containment apparatus of the present invention comprises a pneumatically actuated latching mechanism. Said latching mechanism comprises a substantially planar sliding plate that is restrained from rotating vertically or translating horizontally utilizing a plurality of roller bearings disposed within elongate slots. Said roller bearings are operationally attached to one semi-cylindrical half member (typically the left half member) via a plurality of restraining screws and bearing caps, and are disposed along a face of said sliding plate. As a result, any motion of said sliding plate is thus limited to a relatively vertical translation along the longitudinal axis of said semi-cylindrical members.

In a preferred embodiment, the mud containment apparatus of the present invention further comprises a plurality of inflatable, tubular seal members that are disposed within a slot in a vertical edge of one semi-cylindrical half member, wherein said tubular seal members are held in place using a plurality of seal retainers. When said opposing semi-cylindrical half members of said mud containment apparatus are in a mating or closed position, the vertical edges of one semi-cylindrical half member engages said tubular seal member, thereby enclosing said tubular seal member between the opposing vertical edges of the right semi-cylindrical half member and the left semi-cylindrical half member. When said tubular seal member is inflated, a fluid pressure seal is formed between said opposing vertical edges.

A plurality of pipe seal assemblies—typically four (4)—seal against the external surfaces of pipe at desired locations above and below a threaded connection member when said mud containment apparatus is positioned around said pipe, such as during use. Each pipe seal assembly comprises at least two identical pipe seal members that are vertically disposed a relatively short distance apart from each other, wherein one pipe seal member is inverted relative to the other pipe seal as described more fully below.

Each of said pipe seal members comprises a substantially semi-circular disk having an outer radius and an inner radius. Said outer radius is approximately equal to the inner radius of the semi-cylindrical half members, while said inner radius is approximately equal to the outer radius of pipe around which said mud containment apparatus is being used. Thus, the outer radius of each pipe seal members sealingly engages the inner radius of said semi-cylindrical half members, and the inner radius of each pipe seal members sealingly engages around the outer surface of said pipe.

When the mud containment apparatus is in a closed position around adjacent pipe sections, pipe seal members in one semi-cylindrical half member sealingly engage against the corresponding pipe seal member of the opposing semi-cylindrical half member to create a fluid pressure seal. Further, a semi-circular block or web member attaches to a bottom surface of the upper pipe seal members and to a top surface of the lower pipe seal member to maintain a separation between said upper and lower pipe seal members.

In the closed position, the pipe seal assemblies of the right semi-cylindrical half member and the seal assemblies of the left semi-cylindrical half member sealing engage each other. Further, each of said seal assemblies define a space between an upper pipe seal member and lower pipe seal member. When said mud containment apparatus is closed around pipe, said seal assemblies effectively create an upper pressure chamber located above a pipe connection and a lower pressure chamber located below a pipe connection. Pressurized fluid (typically air) can then be introduced into said pressure chambers.

Air that is introduced into said chambers is at a relatively greater pressure than the pressure exerted by the contents of the mud containment apparatus (that is, drilling mud escaping from a pipe threaded connection being separated). As such, if a small passageway develops between an inner diameter of a pipe seal member and an outer diameter of the pipe, the higher pressure air will prevent the mud or other fluid from leaking past the pressurized air chamber. Further, the extent of any harmless air leakage can indicate a condition of the seals, even while the seals continue to maintain a fluid-tight seal against any mud leakage. As a result, damaged seal members can be changed at a later, more convenient time without resulting in any loss of efficiency or effectiveness during operation of said mud containment apparatus.

In a preferred embodiment, when the mud containment apparatus of the present invention is in operation, a pipe connection that is to be unthreaded is positioned above the floor of a drilling rig, and said pipe connection is loosened according to customary practice. The mud containment apparatus is initially in an open position and is positioned adjacent to said pipe. In this position, a first (lower) pipe seal assembly is located below said pipe connection, and a second (upper) pipe seal assembly is located above said connection. Said mud containment apparatus of the present invention is then closed, thereby encapsulating said drill pipe, and the latching mechanism is engaged in order to secure said opposing first and second semi-cylindrical half members together.

In this position, a valve can be moved to an open position in order to allow a volume of pressurized fluid (typically air) to flow into each seal assembly and into each vertical seal member. An upper pipe section is then rotated, thereby disengaging the threads of the connection. Said upper pipe can then be lifted in a relatively upward direction, thereby separating the upper pipe from a lower pipe section. As a result, drilling mud located within said upper pipe flows out of the lower opening of said pipe and into the surrounding mud containment apparatus. Such drilling mud then drains out of said mud containment apparatus by way of a drain port.

When all of the drilling mud has drained from the mud containment apparatus, the latching mechanism can be disengaged. Thereafter, said opposing first and second semi-cylindrical half members can be spread apart from each other into an open position. The mud containment apparatus can be moved away from the pipe and the process can be repeated.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
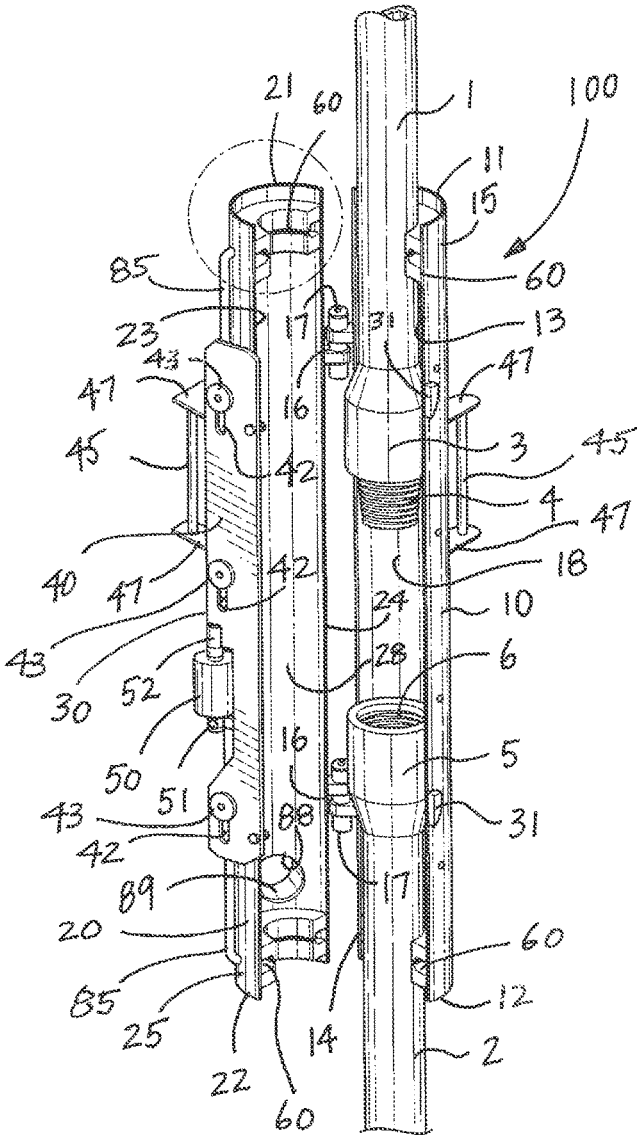
FIG. 1 depicts a side perspective view of a preferred embodiment of a mud containment apparatus of the present invention in an open configuration partially installed around opposing sections of drill pipe.

Referring to the drawings, FIG. 1 depicts a perspective view of a mud containment assembly 100 of the present invention in an open configuration, positioned in proximity to two (2) adjacent sections of drill pipe, an upper drill pipe joint 1 and a lower drill pipe joint 2. Said upper drill pipe joint 1 has downwardly facing pin-end threaded connection member 3 having male threads 4, while lower drill pipe joint has upwardly facing female box-end connection member 5 having female threads 6. Said pin-end and box-end threaded connection members 3 and 5 can be joined to threadedly mate upper drill pipe joint 1 with lower drill pipe joint 2 in accordance with customary drilling practice.

Mud containment assembly 100 generally comprises a first substantially semi-cylindrical member and a second substantially semi-cylindrical member—that is, a right half member 10 and a left half member 20. Said right half member 10 comprises a top end 11, a bottom end 12, an outer (or leading) edge surface 13, and an inner (or hinged) edge surface 14, and defines an inner surface 18. Similarly, said left half member 20 comprises a top end 21, a bottom end 22, an outer (or leading) edge surface 23, and an inner (or hinged) edge surface 24, and defines an inner surface 28.

As depicted in FIG. 1, right half member 10 and left half member 20 are attachably connected to one another using at least one hinge 16. Hinges 16 are vertically disposed along inner edge surface 14 of right half member 10 and along opposing inner edge surface 24 of left half member 20, thereby hingedly connecting right half member 10 to left half member 20. Hinges 16 allow for mud containment assembly 100 of the present invention to swing open and close easily and efficiently. When right half member 10 and left half member 20 are fully connected and engaged in a closed position, right half member 10 and left half member 20 form a substantially cylindrical member that can surround and encapsulate a threaded connection formed between upper drill pipe 1 and lower drill pipe 2.

Semi-cylindrical right half member 10 and left half member 20 can hingedly move between a first open or substantially spread apart position, and a second substantially closed or joined position. In said open position, said semi-cylindrical half members 10 and 20 pivot about said at least one hinge 16 (each having hinge pin 17) in order to spread apart from each other; said at least one hinge 16 pivots about a pivot axis that is substantially parallel to the longitudinal axes of semi-cylindrical half members 10 and 20. In said closed position, said semi-cylindrical half members 10 and 20 pivot about said at least one hinge 16 and move together until the opposing longitudinal edges of said first and second semi-cylindrical half members meet or coincide, thereby forming a substantially closed cylinder.

In a preferred embodiment, latch assembly 30 is operationally attached to one of semi-cylindrical half members 10 or 20; as depicted in FIG. 1, said latch assembly 30 is mounted to left semi-cylindrical half member 20. Latch assembly 30 comprises a substantially planar sliding plate 40 and a fluid powered actuating cylinder 50. Said fluid powered cylinder 50 is anchored to left half member 20 using mounting bracket 51, and has moveable piston rod 52 that can be selectively extended or retracted. Piston rod 52 is operationally attached to sliding plate member 40.

Still referring to FIG. 1, the present invention comprises a plurality of pipe seal assemblies 60. Said pipe seal assemblies 60 are disposed along inner surface 18 of right half member 10 and along inner surface 28 of left half member 20. Said pipe seal assemblies 60 are generally disposed near top end 21 and bottom end 22 of left half member 20, and near top end 11 and bottom end 12 of right half member 10.

An outlet port 88 having hose fitting 89 extends through at least one of said semi-cylindrical half members. In the embodiment depicted in FIG. 1, said outlet port 88 is disposed through left half member 20. Further, said outlet port 88 is beneficially positioned between seal assemblies 60 of right half member 10 and left half member 20. A hose or pipe can be attached to said fitting 89 for evacuating any fluid with mud containment assembly 100 to a mud tank or other desired location. Still referring to FIG. 1, handle members 46 are disposed along outer surface 15 of right half member 10 and outer surface 25 of left half member 20. Said handle members 45 are operationally attached to right and left half members 10 and 20 using plate mounting members 47 and are beneficially positioned to permit ease of access by personnel.

Figure 2:
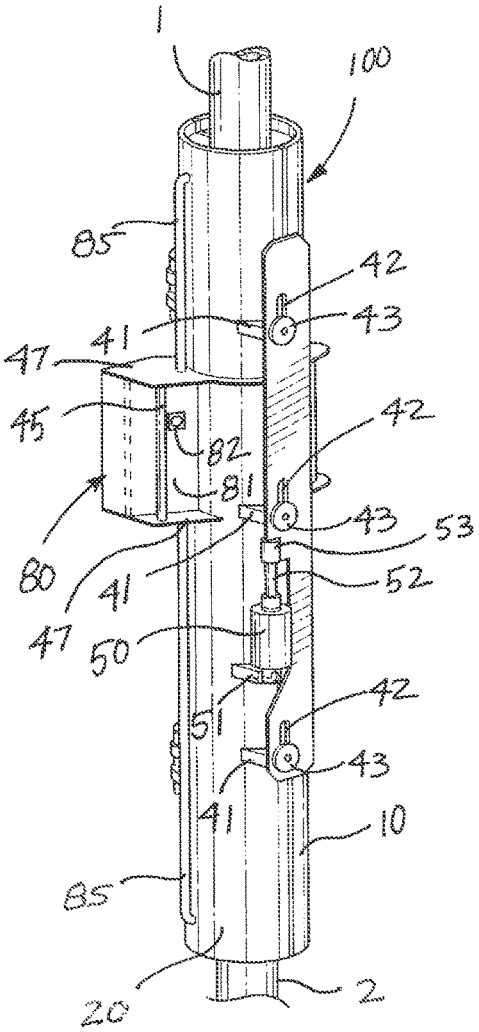
FIG. 2 depicts a side perspective view of a preferred embodiment of a mud containment apparatus of the present invention in a closed configuration installed around opposing sections of drill pipe.

FIG. 2 depicts a perspective view of a mud containment assembly 100 of the present invention in a substantially closed configuration. As depicted in FIG. 2, right half semi-cylindrical member 10 and left half semi-cylindrical member 20 are urged together (and hingedly move together using hinge 16); in this closed configuration, joined right half semi-cylindrical member 10 and left half semi-cylindrical member 20 surround the connection between upper drill pipe joint 1 and lower drill pipe joint 2. Although not depicted in FIG. 2, when mud containment assembly 100 is closed, latch wedge members 31 of right half member 10 cooperate with sliding plate 40 of left half member 20, thereby securing right half member 10 to left half member 20.

Sliding plate 40 having elongate slots 42 is disposed in a relatively vertical orientation, wherein the longitudinal axes of said plate 40 and elongate slots 42 are substantially parallel to the longitudinal axis of left half member 20. Still referring to FIG. 1, a plurality of latch members 31 is disposed along the length of outer leading edge 13 of right half assembly 10. In a preferred embodiment, each of said latch members 31 embodies a relatively wedge-like configuration having a substantially planar outer surface, a relatively straight inner edge, and a tapered outer edge, wherein the width of said latch member 31 is relatively greater at its top end that at its bottom end.

Referring to FIG. 2, fluid powered actuating cylinder 50 is anchored to left half member 20 using mounting bracket 51. Said fluid powered actuation cylinder 50 has moveable piston rod 52 that can be selectively extended or retracted. In a preferred embodiment, said fluid powered actuation cylinder 50 is pneumatically powered. Piston rod 52 is operationally attached to sliding plate member 40 using mounting fitting 53. It is to be observed that extension of piston rod 52 of fluid powered actuation cylinder 50 imparts upward force on plate member 40 thereby causing said plate member 40 to slide in a substantially upward direction. Conversely, retraction of piston rod 52 of fluid powered actuation cylinder 50 imparts downward force on plate member 40 thereby causing said plate member 40 to slide in a substantially downward direction.

As depicted in FIG. 2, in a preferred embodiment, a pneumatic assembly 80 is disposed on outer surface 25 of left half member 20. Valve control 82 is mounted on pneumatic assembly cover plate 81 and is disposed in proximity to handle member 45 in such a manner that actuating valve control 82 can be conveniently actuated by an operator's thumb or finger, while said operator is concurrently grasping handle member 45. Conduits 85 extend from pneumatic assembly 80 to pipe seal assemblies 60, as discussed in greater detail below.

Figure 4:
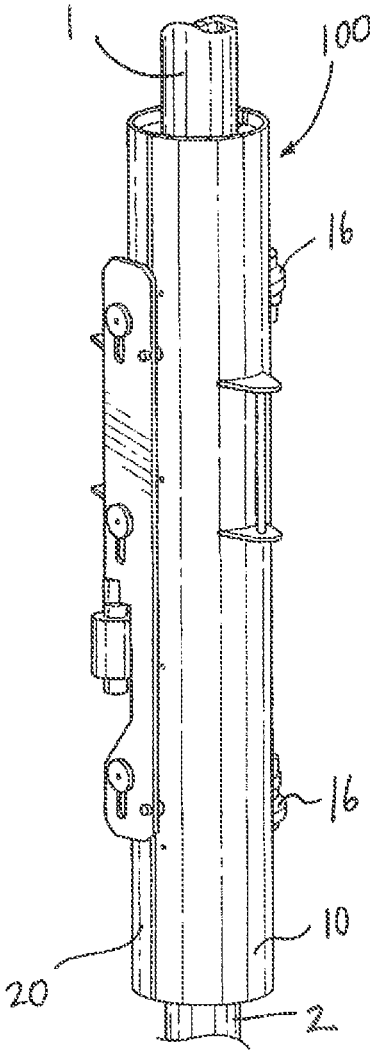
FIG. 4 depicts a side perspective view of a preferred embodiment of a mud containment apparatus of the present invention in a closed configuration installed around opposing sections of drill pipe.

Referring to FIG. 4, a perspective view of mud containment assembly 100 of the present invention is shown in a closed configuration, rotated approximately 90 degrees from the view depicted in FIG. 2. Mud containment assembly generally comprises left half member 20 and right half member 10 joined in hinged relationship. Right half semi-cylindrical member 10 and left half semi-cylindrical member 20 are urged together (about hinge 16); in this closed configuration, joined right half semi-cylindrical member 10 and left half semi-cylindrical member 20 surround the opposing threaded connection members of upper drill pipe joint 1 and lower drill pipe joint 2.

Figure 5:
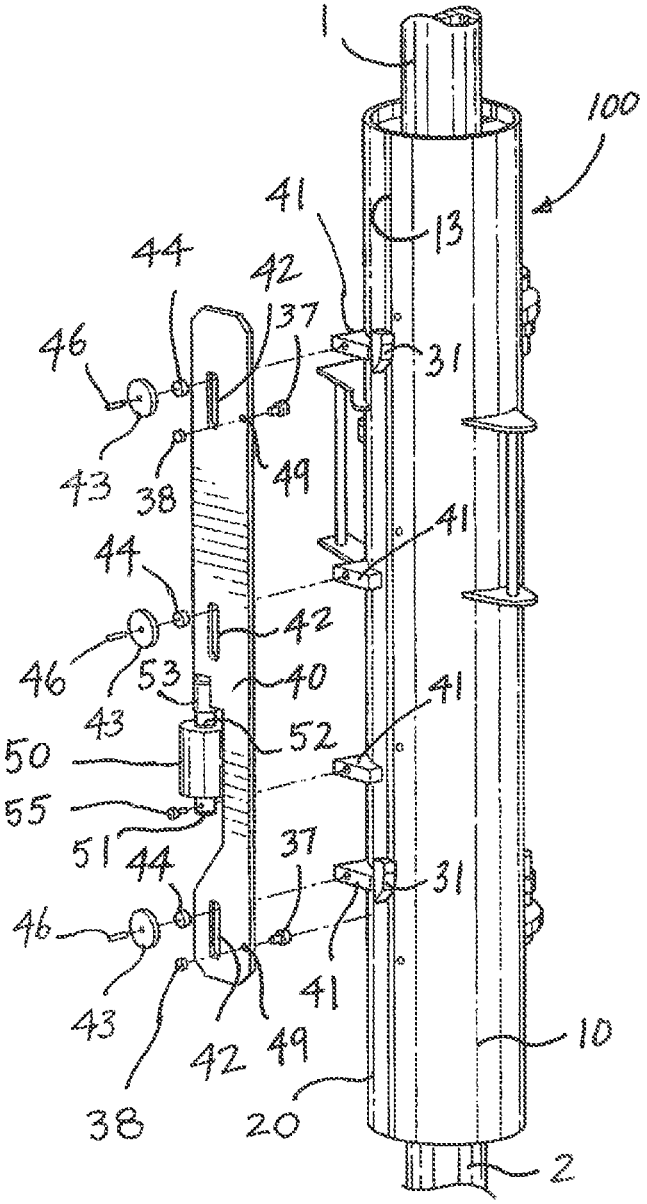
FIG. 5 depicts an exploded side view of a preferred embodiment of a latch assembly of a mud containment apparatus of the present invention.

FIG. 5 depicts an exploded perspective view of sliding plate 40 and pneumatic actuating cylinder 50 of mud containment assembly 100 of the present invention. Sliding plate 40 having elongate slots 42 is disposed in a relatively vertical orientation, wherein the longitudinal axes of said plate 40 and elongate slots 42 are substantially parallel to the longitudinal axis of left half member 20. Said sliding plate 40 is slidably attached to left half member 20 via a plurality of bearings 44 rotatably mounted to bearing mounting bases 41 and slidably received within elongate slots 42. Plate member 40 is secured in place using retention caps 43 and pins 46. Thus, sliding plate 40 can translate along the longitudinal axis of elongate slots 42, but is restrained from any other rotation or translation due to said roller bearings 44 and bearing retention caps 43.

Still referring to FIG. 5, holes 49 extend through sliding plate member 40. Roller bearings 37 are partially received in said holes 49 and are secured to the inner surface of said sliding plate member 40 using fasteners 38. A plurality of latch members 31 is disposed along the length of outer leading edge 13 of right half assembly 10.

Fluid powered actuating cylinder 50 is anchored to left half member 20 using mounting bracket 51 secured to mounting base 54 using pin 55. Said fluid powered actuation cylinder 50 has moveable piston rod 52 that can be selectively extended or retracted, and is operationally attached to sliding plate member 40 using mounting fitting 53. It is to be observed that extension of piston rod 52 of fluid powered actuation cylinder 50 imparts upward force on plate member 40 thereby causing said plate member 40 to slide in a substantially upward direction. Conversely, retraction of piston rod 52 of fluid powered actuation cylinder 50 imparts downward force on plate member 40 thereby causing said plate member 40 to slide in a substantially downward direction.

Figure 6:
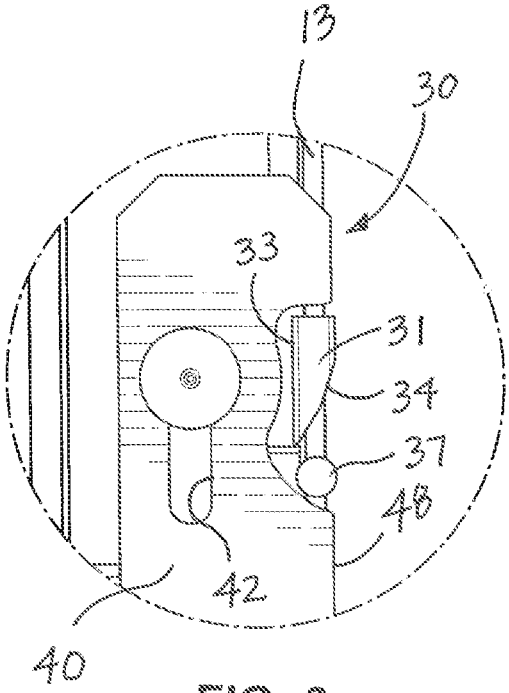
FIG. 6 depicts a detailed side view of a portion of a latch assembly of the present invention in an unlatched configuration.

FIG. 6 depicts a detailed and partially cut-away side view of latch assembly 30 of mud containment assembly 100 of the present invention in unlatched configuration. Latch wedge member 31 is disposed along an outer leading edge 13 of right half member 10, whereby latch wedge member 31 adjacently aligns and coordinates with outer edge 48 of sliding plate 40. Each of said latch members 31 comprises a relatively wedge-like configuration, having a substantially straight left side edge 33 and a relatively tapered right side edge 34, wherein a width of latch wedge member 31 is greater at its upper end than at its lower end. It is to be observed that tapered edge 34 can alternatively have a gentle curve or convex shape along at least part of the length of said surface.

As depicted in FIG. 6, latch roller bearings 37 are disposed along a right edge of sliding plate 40, thereby vertically aligning with latch wedge members 31 when sliding plate 40 is in a disengaged or unlatched position; in this position, latch roller bearings 37 are disposed slightly below latch wedge members 31. Additionally, when sliding plate 40 is in a fully disengaged or unlatched position, bearing 44 is disposed near the upper end of elongate slot 42 of sliding plate 40.

Figure 7:
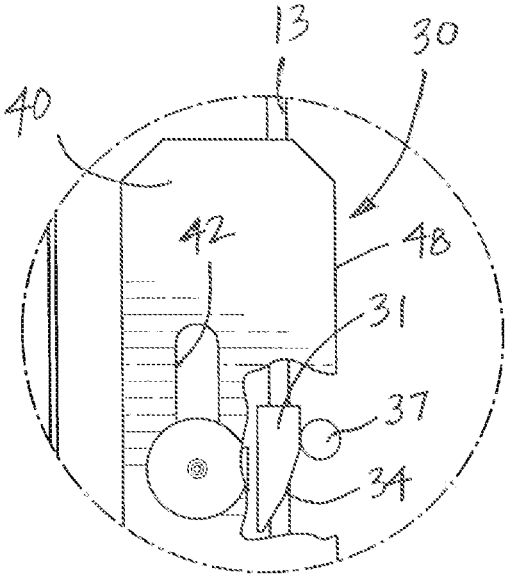
FIG. 7 depicts a detailed side view of a portion of a latch assembly of the present invention in a latched configuration.

FIG. 7 depicts a detailed partial cut away side view of latch assembly 30 of mud containment assembly 100 of the present invention in an engaged or latched configuration. When piston rod 52 of pneumatic actuating cylinder 50 is extended, sliding plate 40 axially translates in a relatively upward direction. Latch roller bearing 37 engages tapered side edge 34 of latch wedge member 31 and travels along said side edge 34 as sliding plate 40 axially shifts. As latch roller bearing 37 (attached to plate 40 which, in turn, is attached to of left half member 20) reaches the upper (thicker) portion of latch wedge member 31 (which is attached to right half member 10), right half member 10 and left half member 20 are urged toward each other and secured together in latched relationship.

Figure 3:
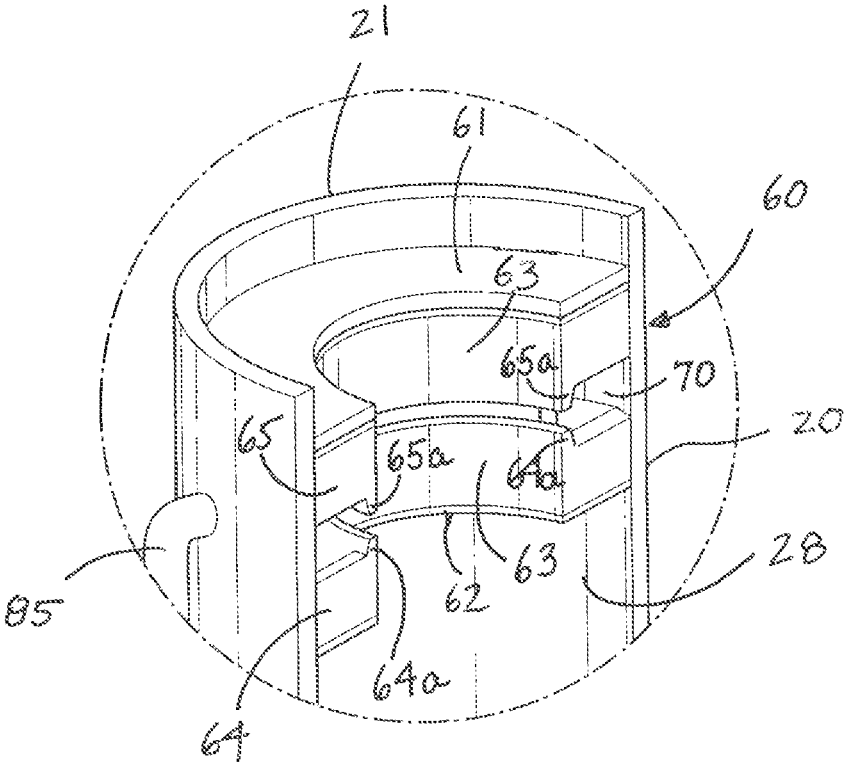
FIG. 3 depicts a detailed perspective view of a preferred embodiment of a seal assembly of a mud containment apparatus of the present invention.

Referring back to FIG. 3, a detailed perspective view of the highlighted portion of FIG. 1, including an upper pipe seal assembly 60, is depicted. As noted in connection with FIG. 1, said pipe seal assembly 60 depicted in FIG. 3 is disposed along inner surface 28 of left half member 20 near top end 21. Pipe seal assembly 60 generally comprises upper plate member 61 and lower plate member 62 that are positioned in substantially parallel orientation relative to each other. Further, although not depicted in FIG. 3, a corresponding and substantially similar pipe seal assembly 60 is disposed along inner surface 18 of right half member 10. As such, this configuration allows pipe seal assemblies 60 of left half member 20 to align and cooperate with pipe seal assemblies 60 of right half member 10 when mud containment assembly 100 of the present invention is in a closed and latched configuration.

As depicted in FIG. 3, a plurality of resilient pipe seal members—typically two (2)—are disposed between upper plate 61 and lower plate 62. Pipe seal members 64 and 65 cooperate with said upper plate 61 and lower plate 62 to align with each other. In a preferred embodiment, said pipe seal members 64 and 65 each have a substantially semi-cylindrical shape defining concave inner surface 63; said concave inner surface 63 beneficially has a substantially similar radius of curvature as a section of pipe to be received within said concave inner surface (such as, for example, pipe joint 1 depicted in FIG. 1).

Pipe seal member 64 has upward lip extension member **64*a* along its inner concave surface 63, while pipe seal member 65 has downward lip extension member 65*a* along its inner concave surface 63. A gap or space is disposed between said pipe seal members 64 and 65, and defines a chamber 70. Conduit 85 extends from pneumatic assembly 80 (not visible in FIG. 3) through said half member 20, and forms an outlet into said chamber 70**.

Figure 8:
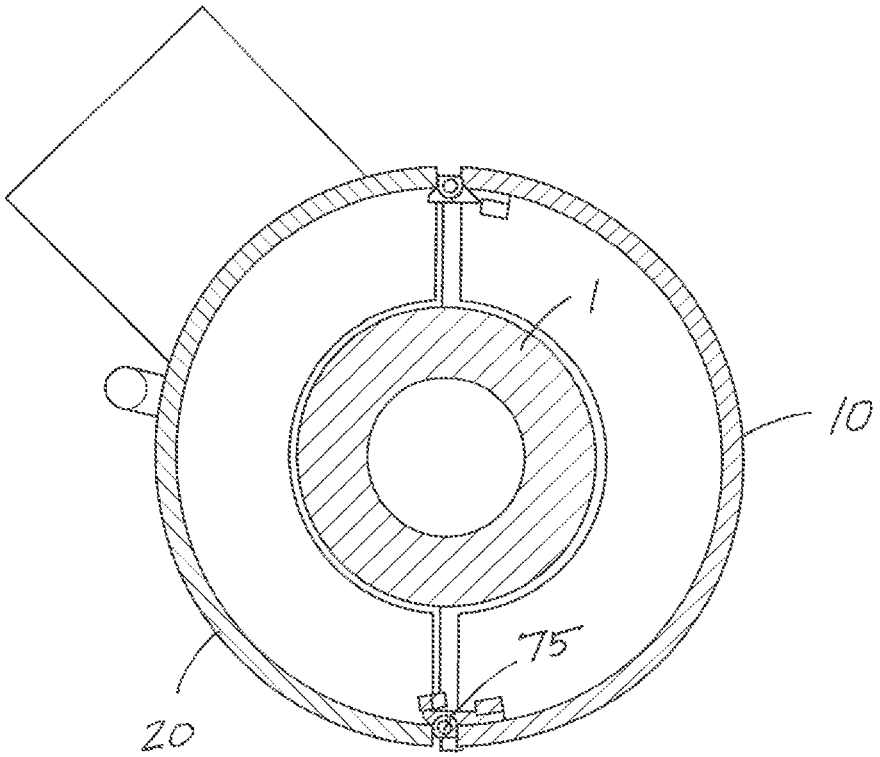
FIG. 8 depicts an overhead sectional view of a preferred embodiment of a mud containment apparatus of the present invention in a closed configuration surrounding drill pipe.

FIG. 8 depicts overhead sectional view of mud containment assembly 100 in a closed configuration. Right half member 10 is hingedly closed against and secured to left half member 20; in this configuration, said right half member 10 and left half member 20 can surround and encapsulate upper drill pipe joint 1 (and lower drill pipe joint 2, not visible in FIG. 8). Additionally, tubular seal members 75 are disposed within inner slots that are positioned in right half member 10, wherein said inner slots are disposed on an edge of right half member 10 and adjacent to a connection point or intersection between right half member 10 and left half member 20 when said half members are closed and latched.

Figure 9:
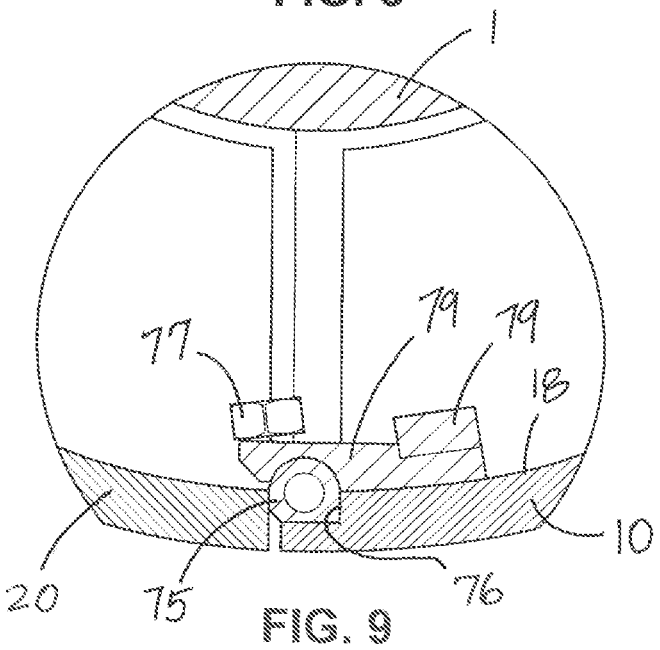
FIG. 9 depicts a detailed sectional view of a tubular seal and retainer of the present invention.

FIG. 9 depicts a detailed cross-sectional view of inflatable tubular seals 75 of mud containment assembly 100 of the present invention. Tubular seals 75 are disposed within inner slots 76, wherein inner slots 76 are disposed on an outer edge of right half member 10 and adjacent to a connection point of right half member 10 to left half member 20. Seal retainer 77 can be manufactured from a resilient material, such as, for example, polyurethane; seal retainer 77 engages tubular seal 75, and thus, retains tubular seal 75 within inner slot 76. Tubular seal 75 is compressed within inner slot 76, thereby causing tubular seal 75 to have a relatively flattened outer surface within inner slot 76. Further, seal retainer bars 79 provide support for seal retainers 77, and are attachably connected to inner surface 18 of right half member 10.

Still referring to FIG. 9, seal retainers 77 are attachably connected to inner surface 18 of right half member 10 via a plurality of mating threaded bolts and nuts. Said bolts extend through right half member 10, through seal retainer 77, and through seal retainer bars 79, thereby providing a secure means of attachment. Additionally, when mud containment assembly 100 of the present invention is in a closed configuration, pipe sealing members 65 form a substantially semi-circular groove that align with seal retainers 77, and thus, enclose tubular seal 75. As a result, when air or other fluid is supplied to tubular seal 75 and said seal member 75 inflates and expands, tubular seal 75 seals also against upper and lower pipe seal assemblies 60.

Figures 10, 11:
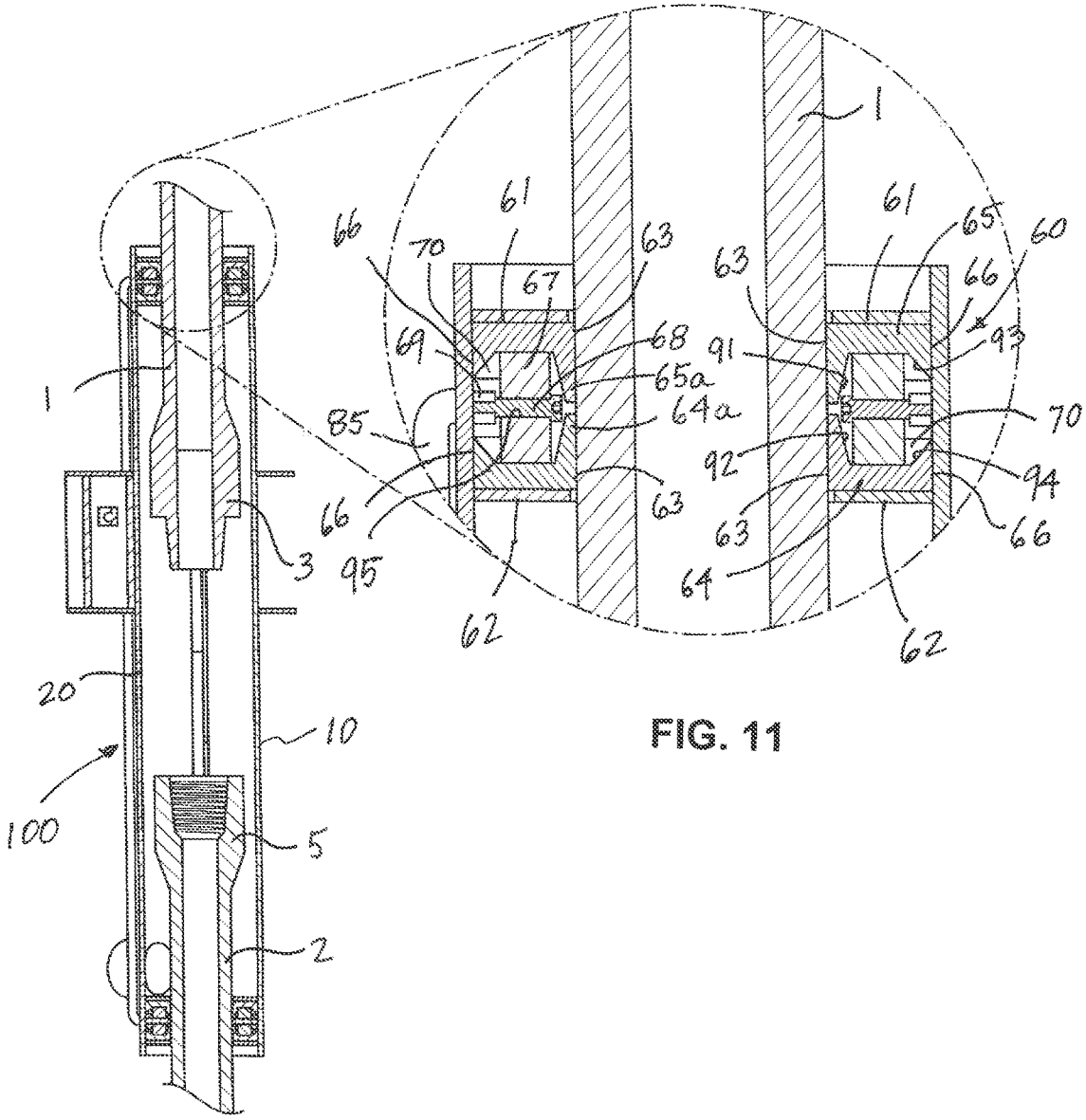
FIG. 10 depicts a side sectional view of a mud containment apparatus of the present invention in a closed configuration installed around opposing sections of drill pipe.
FIG. 11 depicts a detailed view of a highlighted portion of FIG. 10.

FIG. 10 depicts a longitudinal sectional view of mud containment assembly 100 of the present invention. Mud containment assembly 100 encapsulates portions of upper drill pipe section 1 and lower drill pipe section 2. When right half member 10 and left half member 20 of mud containment assembly 100 are closed and secured together, pipe seal assemblies 60 provide a fluid pressure seal against the outer surface 7 of upper drill pipe joint 1 and outer surface 8 of lower drill pipe joint 2 as more fully described herein.

FIG. 11 depicts a detailed view of the highlighted portion of FIG. 10. Mating semi-cylindrical pipe seal assemblies 60 cooperate to surround the outer surface of upper drill pipe section 1. Each of said mating pipe seal assemblies 60 generally comprises substantially parallel upper plate member 61 and lower plate member 62, opposing pipe seal members 64 and 65, an inner web member 67, a retainer screw(s) 68 and a nut(s) 69. In a preferred embodiment, said pipe seal members 64 and 65 each have a substantially semi-cylindrical shape defining concave inner surface 63; said concave inner surface 63 beneficially has a substantially similar radius of curvature as a section of pipe to be received within said concave inner surface 63 (such as, for example, pipe joint 1 depicted in FIG. 11).

Pipe seal member 64 has upward lip extension member 64*a* along its inner concave surface 63, while pipe seal member 65 has downward lip extension member 65*a* along its inner concave surface 63. A gap or space is disposed between said pipe seal members 64 and 65. Still referring to FIG. 11, retainer screw 68 is disposed through bore 95 of inner offset web member 67. A threaded nut 69 is attached to left half member 20 such that retainer screw 68 threadedly engages nut 69 in order to secure inner web member 67 into position relative to said left half member 20. A similar threaded nut 69 and retainer screw 68 is also used to secure an inner pipe web member 67 into position relative to right half member 10. Inner pipe web member 67 can also be operationally attached or coupled to pipe seal members 64 and 65; in a preferred embodiment, extension members protruding from each of said inner pipe web members 67 are received within aligned holes or recesses in said pipe seal members 64 and 65 to couple said components, although other means of attachment can be envisioned without departing from the scope of this invention.

Inner surfaces 92 and 94 of each lower pipe seal member 64 are tapered to define an upward facing cup-like structure, while inner surfaces 91 and 93 of each upper pipe seal member 65 are also tapered to define a downward facing cup-like structure. Introduction of pressurized fluid (typically air) into each chamber 70 causes outer surfaces 66 of lower pipe seal member 64 and upper pipe seal member 65 to flare outward and bias against the inner surface 18 of right half member 10 and inner surface 28 of left half member 20. Similarly, such pressurized fluid also causes inner surfaces 63 of upward lip extension member 64*a* and downward lip extension member 65*a* to flare radially inward and bias against the outer surface of upper pipe joint 1 thereby forming a fluid pressure seal.

Figure 12:
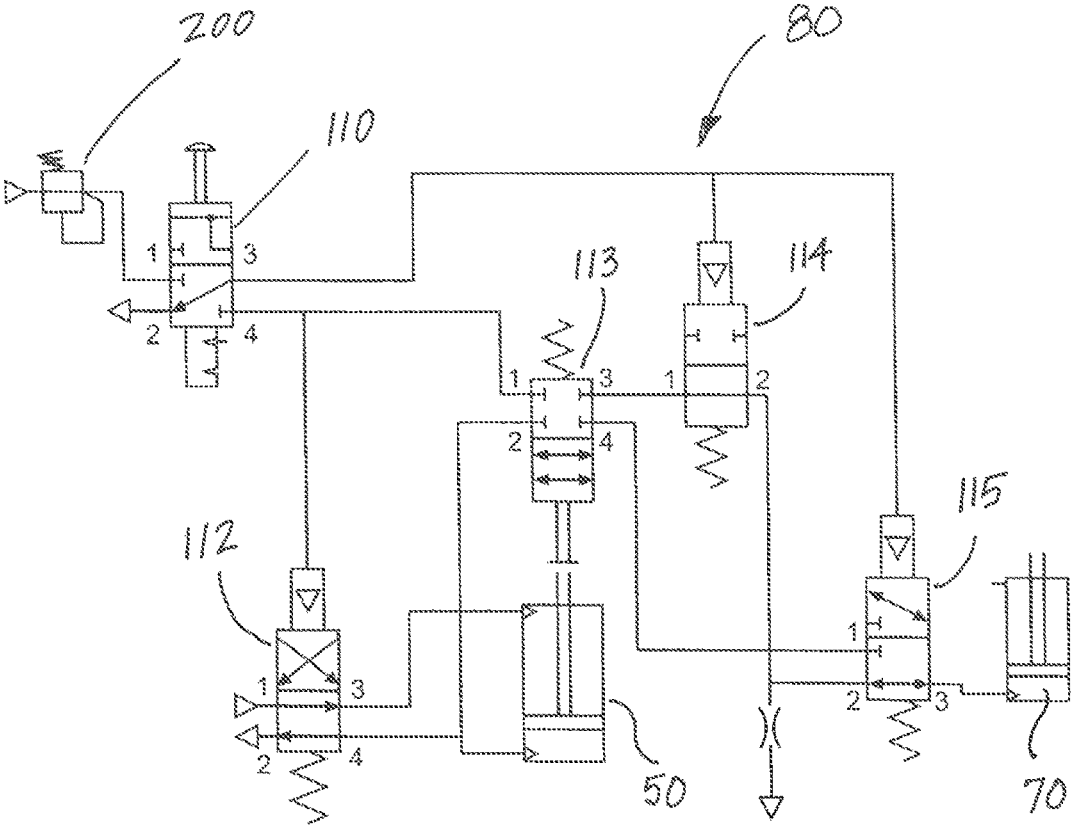
FIG. 12 depicts a schematic diagram of a preferred embodiment of a pneumatic system of a mud containment apparatus of the present invention.

FIG. 12 depicts a schematic diagram of a preferred embodiment of a pneumatic system of mud containment assembly 100 of the present invention. Pneumatic assembly 80 generally controls the pressurization and depressurization of pneumatic cylinder 50, inflatable linear seal member(s) 75 the plurality of radial seal members 64 and 65, and the supply of pressurized gas (typically air) to chambers 70. It is to be observed that pneumatic assembly 80 is supplied with pressurized fluid (such as regulated air) from an acceptable source such as a compressor or rig air system.

Prior to pressurized fluid being supplied to air pressure chambers 70 and seal members 64 and 65, latch assembly 30 must be in a fully engaged or latched position. Moreover, said latch assembly 30 can remain in a fully engaged position until elevated sealing pressure is bled from pressure chambers 70 and seal members 64 and 65. In FIG. 12, pressure chamber 70 and seal members 64 and 65 are each depicted for illustration purposes schematically as a single acting cylinder.

Pneumatic assembly 80 generally comprises valve 110, regulator 200, and a plurality of valves 112, 113, 114 and 115. Valves 112, 114, and 115 are generally pilot-operated valves having a spring return. Valve 113 is mechanically actuated by pneumatic cylinder 50, such that when pneumatic cylinder 50 is in a "full up" and fully engaged position, valve 113 is actuated. Valve 113 can also be a spring return. Further, regulator 200 can limit the pressure that is supplied to the pilots of valves 112, 114, and 115. Valve 110 comprises a push-pull, detent valve, such that when valve 110 is in an "out" position, the pilots of valves 114 and 115 are open to exhaust and the pilot of valve 112 is blocked.

Still referring to FIG. 12, until mud containment assembly 100 is manually closed about upper 1 and lower drill pipe 2, pneumatic cylinder 50 is pressurized to hold latch assembly 30 in a relatively downward position. During operation, when valve 110 (connected to valve control 82, not shown) is depressed, pilots of valves 112, 114, and 115 are then energized. Valve 112 is then able to direct pressure to pneumatic cylinder 50, thereby moving and shifting sliding plate 40 of latch assembly 30 in a relatively upward direction. Valve 113 remains in a blocked position, and valve 114 moves to a blocked position. Valve 115 then moves to connect ports 1 and 3; however, there is no pressure at port 1 because valve 113 is blocked.

Pneumatic cylinder 50 eventually reaches a fully upward position, wherein latch assembly 30 is fully engaged. Valve 113 is then actuated, and ports 1-3 and 2-4 of valve 113 are connected. Pressurized fluid at port 1 of valve 112 is directed through ports 2-4 of valve 113 and ports 1-3 of valve 115, and then to pressure chambers 70 (via conduits 85, not shown) and inflatable tubular seal 75.

When separation of mud containment assembly 100 is desired, depressurization is then initiated. Valve 110 is actuated. The pilots of valve 114 and valve 115 bleed in order to exhaust through ports 3-2 of valve 110. Pressure chamber 70 and inflatable tubular seal 75 are then able to bleed in order to exhaust through ports 3-2 of valve 115. The pilot of valve 112 is connected to port 2 of valve 115 through ports 2-4 of valve 113 (wherein pneumatic cylinder 50 is still in a fully upward position) and through ports 1-2 of valve 114. As such, valve 112 is able to remain energized as long as the amount of pressure within air chamber 70 is sufficient to actuate the pilot of valve 112, and valve 112 holds pneumatic cylinder 50 and latch assembly 30 in a fully upward position.

Pressure within pressure chamber 70 is then able to drop below an activation pressure of pilot of valve 112, wherein valve 112 then moves to shift pneumatic cylinder 50 in a relatively downward direction. A relatively small linear downward movement of pneumatic cylinder 50 moves valve 113 to its original blocked position, and the pneumatic system is returned to its initial configuration.

In operation, a threaded pipe connection that is to be disconnected is positioned above the floor of a drilling rig and secured in place. Said pipe connection is then loosened or "broken out" according to customary practice. Mud containment assembly 100 (which is typically hung or otherwise suspended a desired height above the rig floor) is initially in an open position and is positioned adjacent to said pipe. Thereafter, once said mud containment assembly 100 is positioned in a desired location relative to said pipe sections and threaded connection, first and second semi-cylindrical half members can be closed against each other and securely latched together using latch mechanism 30.

An upper pipe section is then rotated, thereby fully disengaging the threads of said threaded pipe connection. Said upper pipe can then be lifted in a relatively upward direction, thus separating the upper pipe from a lower pipe section. As a result, any drilling mud or other liquid present within said upper pipe section will flow out of the lower opening of said pipe section and into the surrounding mud containment apparatus. Such liquid is then permitted to evacuate out of the closed mud containment apparatus by way of a drain port and attached hose, which can direct such liquid to a mud tank or other collection point for ultimate reuse or reclamation.

Referring back to FIG. 10, mud containment assembly 100 is depicted in a closed and sealed position encasing separated upper pipe joint 1 and lower pipe joint 2. In this position, a first pair of opposing and aligned pipe seal assemblies 60 (one on the inner surface of left half member 20 and one on the inner surface of right half member 10) is located below said pipe connection adjacent to the tube body of lower pipe joint 2. Similarly, a second pair of opposing and aligned pipe seal assemblies 60 (one on the inner surface of left half member 20 and one on the inner surface of right half member 10) is also located above said pipe connection adjacent to the tube body of upper joint 1. With mud containment assembly 100 in a closed position, said pipe seal assemblies 60 of right semi-cylindrical half member 10 and seal assemblies 60 of left semi-cylindrical half member 20 sealingly engage each other and create fluid pressure seals against the outer surfaces of said upper and lower pipe sections.

Referring to FIG. 11, each of said seal assemblies 60 defines a void space or pressure chamber 70 between an upper pipe seal member 65 and lower pipe seal member 64. Pressurized fluid (typically air) can then be introduced into said pressure chamber 70 via conduit 85 in order to energize said seal members 64 and 65, and form a fluid pressure seal against the outer surface of upper pipe section 1. Referring back to FIG. 10, it is to be observed that a pair of opposing and aligned pipe seal assemblies 60 (one on the inner surface of left half member 20 and one on the inner surface of right half member 10) is also located below box-end connection member 5 in order to form a fluid pressure seal against the outer surface of lower pipe joint 2.

In a preferred embodiment, air that is introduced into said chambers 70 of seal assemblies 60 is at a relatively greater pressure than the pressure exerted by the contents of mud containment assembly 100 (that is, drilling mud draining from pin end connection 3 of upper pipe joint 1). As such, even if a small passageway develops between an inner surface 63 of a pipe seal assembly 60 and an outer surface of a pipe section, the higher pressurized air will prevent such mud or other fluid from leaking past the engaged seal assemblies 60. Further, the extent of any harmless air leakage can indicate possible damage to sealing members 64 or 65 of said seal assemblies 60, even while said sealing members 64 or 65 continue to maintain a fluid-tight seal against any mud leakage. As a result, any damaged seal members can be changed at a later, more convenient time without resulting in any loss of efficiency or effectiveness during operation of said mud containment assembly 100.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A mud containment assembly for containing and collecting drilling mud flowing from a threaded pipe connection during separation of said threaded pipe connection comprising:

a) a first semi-cylindrical half member having a fluid outlet port;

b) a second semi-cylindrical half member;

c) a hinge disposed between said first and second semi-cylindrical half members adapted to permit said first and second half members to move between a first open position and a second closed position, wherein said first and second half members are adapted to substantially encase said threaded connection in said closed position;

d) an inflatable seal member disposed between said first semi-cylindrical half member and second semi-cylindrical half member;

e) a first radial seal assembly disposed above said threaded connection when said first and second half members are in said closed position, wherein said first radial seal assembly is adapted to provide a fluid pressure seal against an external surface of a pipe section when said first and second semi-cylindrical half members are in said closed position;

f) a second radial seal assembly disposed below said threaded connection when said first and second half members are in said closed position, wherein said first second radial seal assembly is adapted to provide a fluid pressure seal against an external surface of a pipe section when said first and second semi-cylindrical half members are in said closed position; and g) a latch assembly for selectively securing said first and second half members in said closed position, wherein said first radial seal assembly, second radial seal assembly and latch assembly are pneumatically operated.

2. A mud containment assembly for containing and collecting drilling mud during separation of a threaded pipe connection between an upper pipe joint and a lower pipe joint comprising:

a) a first semi-cylindrical half member having an internal surface and a fluid outlet port;

b) a second semi-cylindrical half member having an internal surface, hingedly attached to said first semi-cylindrical half member, wherein said first and second semi-cylindrical half members are adapted to move between a first open position and a second closed position that substantially encases said threaded connection;

c) a first seal assembly, wherein said first seal assembly comprises a first pair of spaced apart elastomer sealing members defining a gap between said sealing members and disposed along said internal surface of said first semi-cylindrical half member, and a second pair of spaced apart elastomer sealing members defining a gap between said sealing members and disposed along said internal surface of said second semi-cylindrical half member, and wherein said first and second pairs of sealing members are aligned with each other above said threaded connection, and wherein said first seal assembly is adapted to provide a fluid pressure seal against an external surface of said upper pipe section above said threaded connection when said first and second semi-cylindrical half members are in said closed position;

d) a second seal assembly, wherein said second seal assembly is adapted to provide a fluid pressure seal against an external surface of said lower pipe section below said threaded connection when said first and second semi-cylindrical half members are in said closed position; and e) a latch assembly for selectively securing said first and second half members in said closed position.

3. The mud containment assembly of claim 2, wherein fluid is injected in said gaps formed between said first and second pairs of sealing members to force a portion of said sealing members against said external surface of said upper pipe section.

4. The mud containment assembly of claim 3, wherein said fluid injection pressure exceeds the pressure imparted on said first seal assembly by said drilling mud.

5. The mud containment assembly of claim 2, wherein said second seal assembly comprises a third pair of spaced apart elastomer sealing members defining a gap between said sealing members and disposed along said internal surface of said first semi-cylindrical half member, and a fourth pair of spaced apart elastomer sealing members defining a gap between said sealing members and disposed along said internal surface of said second semi-cylindrical half member, and wherein said third and fourth pairs of sealing members are aligned with each other below said threaded connection.

6. The mud containment assembly of claim 5, wherein fluid is injected in said gaps formed between said third and fourth pairs of sealing members to force a portion of said sealing members against said external surface of said upper pipe section.

7. The mud containment assembly of claim 6, wherein said fluid injection pressure exceeds the pressure imparted on said second seal assembly by said drilling mud.

8. The mud containment assembly of claim 2, wherein said latch assembly further comprises:

a) an elongate member slidably attached to said first semi-cylindrical member;

b) at least one latch member disposed on said second semi-cylindrical member; and c) a fluid powered cylinder having a first end and a second end, wherein said first end is operationally attached to said first semi-cylindrical member, said second end is operationally attached to said elongate member, and actuation of said fluid powered cylinder reciprocates said elongate member between a first latched position and a second unlatched position.

9. The mud containment assembly of claim 8, further comprising at least one bearing disposed on said elongate member, wherein said at least one bearing cooperates with said at least one latch member to secure said first and second semi-cylindrical members together in said first latched position.

10. The mud containment assembly of claim 9, wherein said first seal assembly, second seal assembly and fluid powered cylinder are pneumatically operated.

11. A mud containment assembly for containing and collecting drilling mud during separation of a threaded pipe connection between an upper pipe joint and a lower pipe joint comprising:

a) a first semi-cylindrical half member having an internal surface and a fluid outlet port;

b) a second semi-cylindrical half member having an internal surface, hingedly attached to said first semi-cylindrical half member, wherein said first and second semi-cylindrical half members are adapted to move between a first open position and a second closed position that substantially encases said threaded connection;

c) a first seal assembly comprising a first pair of spaced apart elastomer sealing members disposed along said internal surface first semi-cylindrical half member and defining a gap between said sealing members, and a second pair of spaced apart elastomer sealing members disposed along said internal surface of said second semi-cylindrical half member and defining a gap between said sealing members, and wherein said first and second pairs of sealing members are aligned with each other and are adapted to cooperate to provide a fluid pressure seal against an external surface of said upper pipe section above said threaded connection when said first and second semi-cylindrical half members are in said closed position;

d) a second seal assembly comprising a third pair of spaced apart elastomer sealing members disposed along said internal surface first semi-cylindrical half member and defining a gap between said sealing members, and a fourth pair of spaced apart elastomer sealing members disposed along said internal surface of said second semi-cylindrical half member and defining a gap between said sealing members, and wherein said third and fourth pairs of sealing members are aligned with each other and are adapted to cooperate to provide a fluid pressure seal against an external surface of said lower pipe section below said threaded connection when said first and second semi-cylindrical half members are in said closed position; and e) a latch assembly for selectively securing said first and second half members in said closed position.

12. The mud containment assembly of claim 11, wherein fluid is injected into said gaps between said first and second pairs of spaced apart elastomer sealing elements to force a portion of said first and second pairs of sealing elements against said external surface of said upper pipe section, and fluid is injected into said gap between said third and fourth pairs of spaced apart elastomer sealing elements to force a portion of said third and fourth pairs of sealing elements against said external surface of said lower pipe section.

13. The mud containment assembly of claim 12, wherein said injection pressure of said fluid injected into said gaps between said first and second pairs of sealing members exceeds the pressure imparted on said first and second pairs of sealing members by said drilling mud.

14. The mud containment assembly of claim 12, wherein said injection pressure of said fluid injected into said gaps between said third and fourth pairs of sealing members exceeds the pressure imparted on said third and fourth pairs of sealing members by said drilling mud.

15. The mud containment assembly of claim 11, wherein said latch assembly further comprises:

a) an elongate member slidably attached to said first semi-cylindrical member;

b) at least one latch member disposed on said second semi-cylindrical member; and c) a fluid powered cylinder having a first end and a second end, wherein said first end is operationally attached to said first semi-cylindrical member, said second end is operationally attached to said elongate member, and actuation of said fluid powered cylinder reciprocates said elongate member between a first latched position and a second unlatched position.

16. The mud containment assembly of claim 15, further comprising at least one bearing disposed on said elongate member, wherein said at least one bearing cooperates with said at least one latch member in said first latched position to secure said first and second semi-cylindrical members together.

* * * * *